US012376728B2

(12) United States Patent
Reunanen et al.

(10) Patent No.: US 12,376,728 B2
(45) Date of Patent: Aug. 5, 2025

(54) DISHWASHER WITH DETERGENT DISPENSER

(71) Applicant: Electrolux Appliances Aktiebolag, Stockholm (SE)

(72) Inventors: Kristian Reunanen, Stockholm (SE); Ivar Siosteen, Varmdo (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 18/615,780

(22) Filed: Mar. 25, 2024

(65) Prior Publication Data

US 2024/0225413 A1 Jul. 11, 2024

Related U.S. Application Data

(63) Continuation of application No. 17/414,517, filed as application No. PCT/EP2018/086678 on Dec. 21, 2018, now Pat. No. 11,937,756.

(51) Int. Cl.

| | |
|---|---|
| ***A47L 15/14*** | (2006.01) |
| ***A47L 15/42*** | (2006.01) |
| ***A47L 15/44*** | (2006.01) |
| ***A47L 15/50*** | (2006.01) |

(52) U.S. Cl.

CPC ..... *A47L 15/4436* (2013.01); *A47L 15/14* (2013.01); *A47L 15/4257* (2013.01); *A47L 15/4409* (2013.01); *A47L 15/50* (2013.01)

(58) Field of Classification Search

None

See application file for complete search history.

(56) References Cited

U.S. PATENT DOCUMENTS

| | | | |
|---|---|---|---|
| 4,735,228 | A | 4/1988 | Boedecker et al. |
| 5,186,912 | A | 2/1993 | Steindorf et al. |
| 5,483,989 | A | 1/1996 | Lim |
| 5,603,431 | A | 2/1997 | Tuller |
| 6,622,896 | B2 | 9/2003 | Hegeman et al. |
| 6,773,668 | B1 | 8/2004 | Everson et al. |
| 7,275,552 | B2 | 10/2007 | DeWeerd et al. |
| 7,475,696 | B2 | 1/2009 | Vanderroest et al. |
| 8,608,866 | B2 | 12/2013 | Francisco et al. |
| 9,034,114 | B2 | 5/2015 | Bertsch et al. |
| 9,392,924 | B2 | 7/2016 | Bertsch et al. |
| 9,717,393 | B2 | 8/2017 | Delgado et al. |
| 9,861,257 | B2 | 1/2018 | Durham et al. |

(Continued)

FOREIGN PATENT DOCUMENTS

| | | | |
|---|---|---|---|
| CN | 1712623 | A | 12/2005 |
| CN | 2823297 | A | 10/2006 |

(Continued)

OTHER PUBLICATIONS

International Search Report and Written Opinion for International Application No. PCT/EP2018/086678, dated Aug. 23, 2019, 13 pages.

(Continued)

*Primary Examiner* — Levon J Shahinian

(74) *Attorney, Agent, or Firm* — Bradley Arant Boult Cummings LLP

(57) ABSTRACT

A dishwasher detergent dispenser having a set of restraints configured to retain a detergent tablet in a cavity of the detergent dispenser, and a water outlet configured to release water to a top section of the detergent dispenser.

18 Claims, 4 Drawing Sheets

(56) References Cited

U.S. PATENT DOCUMENTS

| | | | |
|---|---|---|---|
| 10,117,561 | B2 | 11/2018 | Kan et al. |
| 10,413,153 | B2 | 9/2019 | Detko |
| 11,412,911 | B2 | 8/2022 | Reunanen |
| 11,937,756 | B2 | 3/2024 | Reunanen et al. |
| 2005/0045672 | A1 | 3/2005 | Marone |
| 2005/0126607 | A1 | 6/2005 | Haft et al. |
| 2005/0126608 | A1 | 6/2005 | DeWeerd et al. |
| 2005/0224098 | A1 | 10/2005 | Fujii et al. |
| 2005/0274157 | A1 | 12/2005 | Yang |
| 2009/0119849 | A1 | 5/2009 | Hill et al. |
| 2011/0174346 | A1 | 7/2011 | Kessler et al. |
| 2016/0220094 | A1 | 8/2016 | Durham et al. |
| 2018/0171530 | A1 | 6/2018 | Hendrickson et al. |
| 2018/0214003 | A1 | 8/2018 | Krische et al. |
| 2018/0344126 | A1 | 12/2018 | Minde et al. |
| 2020/0237179 | A1 | 7/2020 | Haegermarck et al. |
| 2020/0397213 | A1 | 12/2020 | Kwon |

FOREIGN PATENT DOCUMENTS

| | | | |
|---|---|---|---|
| CN | 200980655 | Y | 11/2007 |
| CN | 107616772 | | 1/2018 |
| CN | 107847101 | A | 3/2018 |
| CN | 110693416 | | 1/2020 |
| DE | 2508730 | | 9/1976 |
| DE | 3804302 | A1 | 8/1989 |
| DE | 19841110 | A1 | 3/1999 |
| DE | 20311433 | | 12/2003 |
| EP | 0545127 | | 11/1992 |
| EP | 1703012 | | 9/2006 |
| EP | 1849907 | | 10/2007 |
| EP | 1929920 | | 6/2008 |
| EP | 2138088 | | 12/2009 |
| EP | 2240065 | A1 | 10/2010 |
| EP | 2404538 | | 11/2012 |
| EP | 2923627 | | 9/2015 |
| EP | 3069648 | | 9/2016 |
| EP | 3598931 | | 1/2020 |
| GB | 1134483 | | 11/1968 |
| GB | 1289413 | A | 9/1972 |
| GB | 1521760 | | 8/1978 |
| GB | 2321590 | | 8/1998 |
| JP | 2000210243 | | 8/2000 |
| JP | 2000300498 | | 10/2000 |
| JP | 3736194 | B2 | 1/2006 |
| JP | 2009082393 | | 4/2009 |
| JP | 4675287 | | 4/2011 |
| KR | 19980033950 | | 9/1998 |
| WO | 2006069827 | | 7/2006 |
| WO | 2009083576 | | 7/2009 |
| WO | 2016075644 | | 5/2016 |
| WO | 2017036513 | | 3/2017 |
| WO | 2018036630 | | 3/2018 |
| WO | 2018099671 | | 6/2018 |
| WO | 2019156503 | | 8/2019 |
| WO | 2020126044 | | 6/2020 |

OTHER PUBLICATIONS

International Search Report and Written Opinion for International Application No. PCT/EP2018/067037, dated Sep. 24, 2018, 9 pages.

International Search Report and Written Opinion for International Application No. PCT/EP2019/063279, dated Jan. 28, 2020; 10 pages.

China National Intellectual Property Administration, Chinese Patent Application No. 201980096660.5; Office Action dated Mar. 12, 2024, 9 pages.

European Patent Office, European Application No. 19726650.5, Examination Report dated May 13, 2024, 8 pages.

Patent Cooperation Treaty, International Application No. PCT/EP2018/067037, Written Opinion of the International Searching Authority dated Sep. 24, 2018, 6 pages.

China National Intellectual Property Administration, Chinese Patent Application No. 201880094958.8; Office Action dated Dec. 13, 2023. 10 pages.

European Patent Office, European Application No. 22152625.4, Examination Report dated Nov. 18, 2024, 4 pages.

European Patent Office, European Application No. 22152627.0, Examination Report dated Nov. 18, 2024, 4 pages.

IP Australia, Australian Application No. 2023258351, Examination Report dated Nov. 22, 2024, 3 pages.

IP Australia, Australian Application No. 2023258353, Examination Report dated Nov. 21, 2024, 6 pages.

DISHWASHER WITH DETERGENT DISPENSER

CROSS-REFERENCE TO RELATED APPLICATIONS

This application is a continuation of U.S. patent application Ser. No. 17/414,517, filed Jun. 16, 2021, which is a 371 of PCT/EP2018/086678 Dec. 21, 2018, the entire disclosure of which is incorporated by reference herein.

TECHNICAL FIELD

The invention relates to a dishwasher. In particular the present invention relates to a dishwasher having a detergent dispenser. The invention also relates to an arrangement comprising a detergent dispenser and to a detergent dispenser for a dishwasher.

BACKGROUND

Dishwashers typically have detergent dispensers that are arranged on the inner wall of the door of the dishwasher. The detergent dispensers are containers provided with a lid that is automatically opened during washing so as to output the detergent for washing crockery.

Detergent tablets are often used for washing crockery. The tablet is inserted manually into the detergent dispenser and, after the lid connected to the detergent dispenser is opened, falls into a zone of the dishwasher in which the washing water dissolves the tablet to wash the crockery.

However, the tablet, after the lid is opened, often does not fall into a zone of the dishwasher that is suitable for the complete dissolution thereof. Thus, at the end of the washing step, the tablet is not completely dissolved, with unpleasant consequences due to the poor washing of the crockery.

EP2138088 describes a detergent dispenser where the tablet is prevented from falling into the dishwasher by a grille or by two vertical elements.

There is a constant desire to improve the dishwashers and to make the washing in dishwashers more efficient. Hence, there is a need for a dishwasher that improves upon how the detergent tablet is dissolved.

SUMMARY

It is an object of the present invention to provide an improved dishwasher and in particular an improved dishwasher having a detergent dispenser.

These objects and other are obtained by an arrangement, a detergent dispenser for a dishwasher and a dishwasher as set out in the appended claims.

In accordance with a first aspect of the present invention, an arrangement for a dishwasher is provided. The arrangement comprises a detergent dispenser. The detergent dispenser comprises a set of tablet restraints for retaining a detergent tablet in a cavity of the detergent dispenser; and a water outlet configured to release water to a top section of the detergent dispenser. Hereby water can be supplied to the detergent dispenser in a controlled manner. For example, when a lid of the detergent dispenser is opened, water can flow onto the detergent tablet placed in the detergent dispenser from the water outlet above the detergent dispenser, which outlet releases water onto the door or the top of the dispenser in a controlled manner. The detergent tablet can thereby be dissolved completely in a controlled manner while kept in the detergent dispenser.

In accordance with one embodiment, the tablet restraints are located at a bottom surface of the cavity in the detergent dispenser. Hereby the restraints can be made small and the detergent tablet can be easily placed in the detergent dispenser.

In accordance with one embodiment, the bottom surface has a sloped surface. Hereby the risk that the detergent tablet leaves residues in the detergent dispenser is reduced.

In accordance with one embodiment, the tablet restraints are formed as teeth provided with an upwards facing portion forming an acute angle. The upwards facing portion is adapted to form a support against which a detergent tablet can rest when placed in the cavity of the detergent dispenser. Hereby the risk that the detergent tablet leaves residues in the detergent dispenser is reduced.

In accordance with a second aspect of the invention, a detergent dispenser for a dishwasher is provided. The detergent dispenser has a set of teeth located at a bottom surface of the detergent dispenser for retaining a detergent tablet in the detergent dispenser. The teeth are provided with an upwards facing portion forming an acute angle, wherein said upwards facing portion is adapted to form a support against which a detergent tablet can rest when placed in the detergent dispenser. Hereby the risk that the detergent tablet leaves residues in the detergent dispenser is reduced.

In accordance with one embodiment, the bottom section of the detergent dispenser has a sloped surface.

In accordance with one embodiment a top section with openings for allowing water to enter the detergent dispenser is provided in the detergent dispenser.

In accordance with one embodiment, rails are located on the bottom section of the detergent dispenser.

The invention also extends to a dishwasher comprising an arrangement or a detergent dispenser according to the above.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. Some components can be omitted from different embodiments. Like numbers refer to like elements throughout the description.

Figure 1:
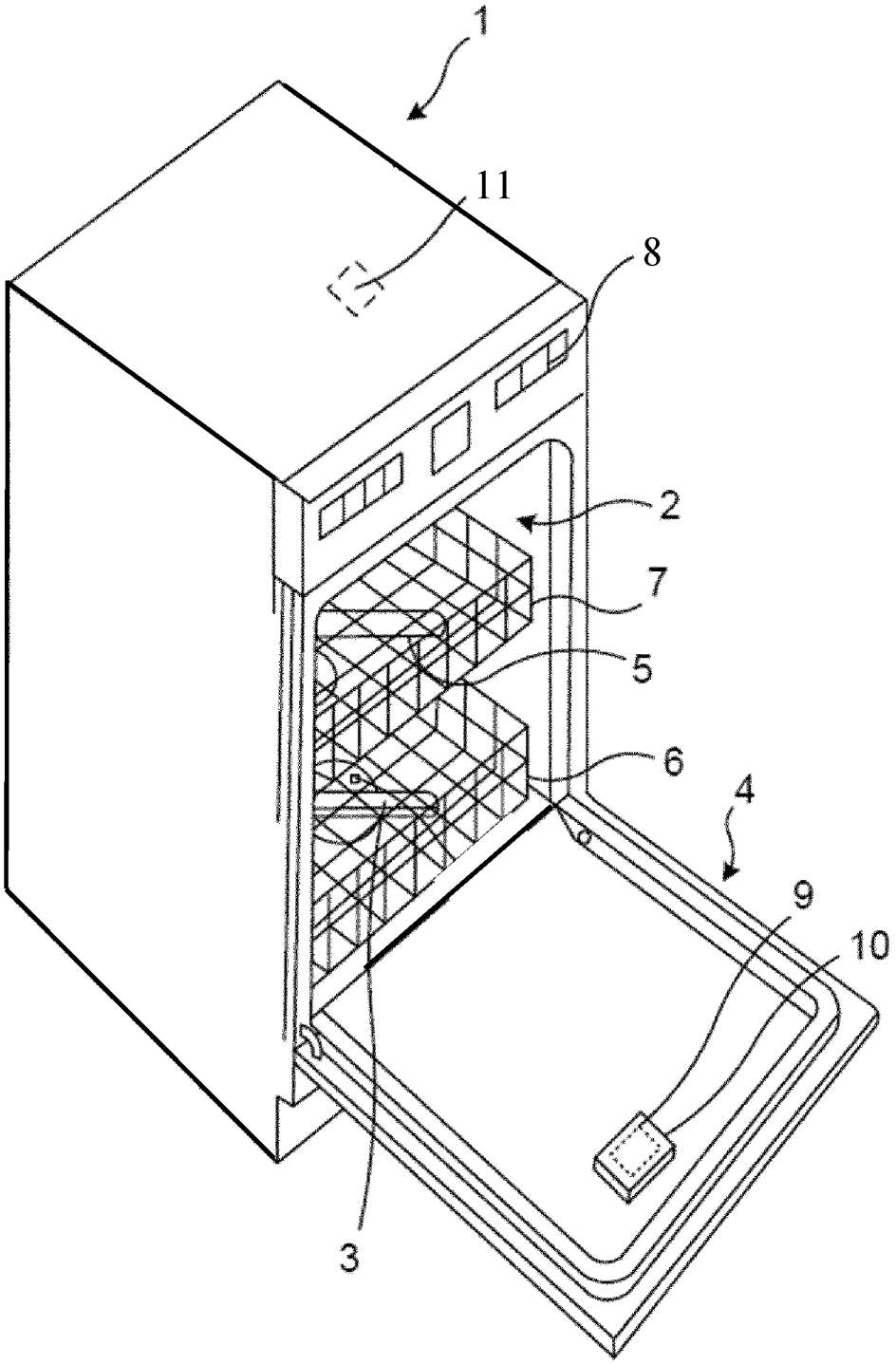
FIG. 1 is a view of a dishwasher.

In FIG. 1, a dishwasher 1 is shown. The exemplary dishwasher 1 comprises a washing compartment or tub 2, a door 4 configured to close and seal the washing compartment 2, a spraying system having a lower spray arm 3 and an upper spray arm 5, a lower rack 6 and an upper rack 7.

Additionally, it may comprise a specific top rack for cutlery (not shown). A controller 11 such as a microprocessor can typically be arranged in the interior of the dishwasher for controlling washing programs and is communicatively connected to an interface 8 via which a user can select washing programs.

The door 4 of the exemplary dishwasher 1 of FIG. 1 is further on its inside arranged with a detergent dispenser 9. The dispenser 9 can in some embodiments have a lid 10 being controllably opened and closed by the controller 11 for dispensing detergent from the dispenser 9 into the tub 2. In the dispenser a detergent tablet or similar can be placed. The term detergent tablet used herein refers to any type of unit with detergent such as a detergent pad or a detergent capsule or similar.

Figure 2:
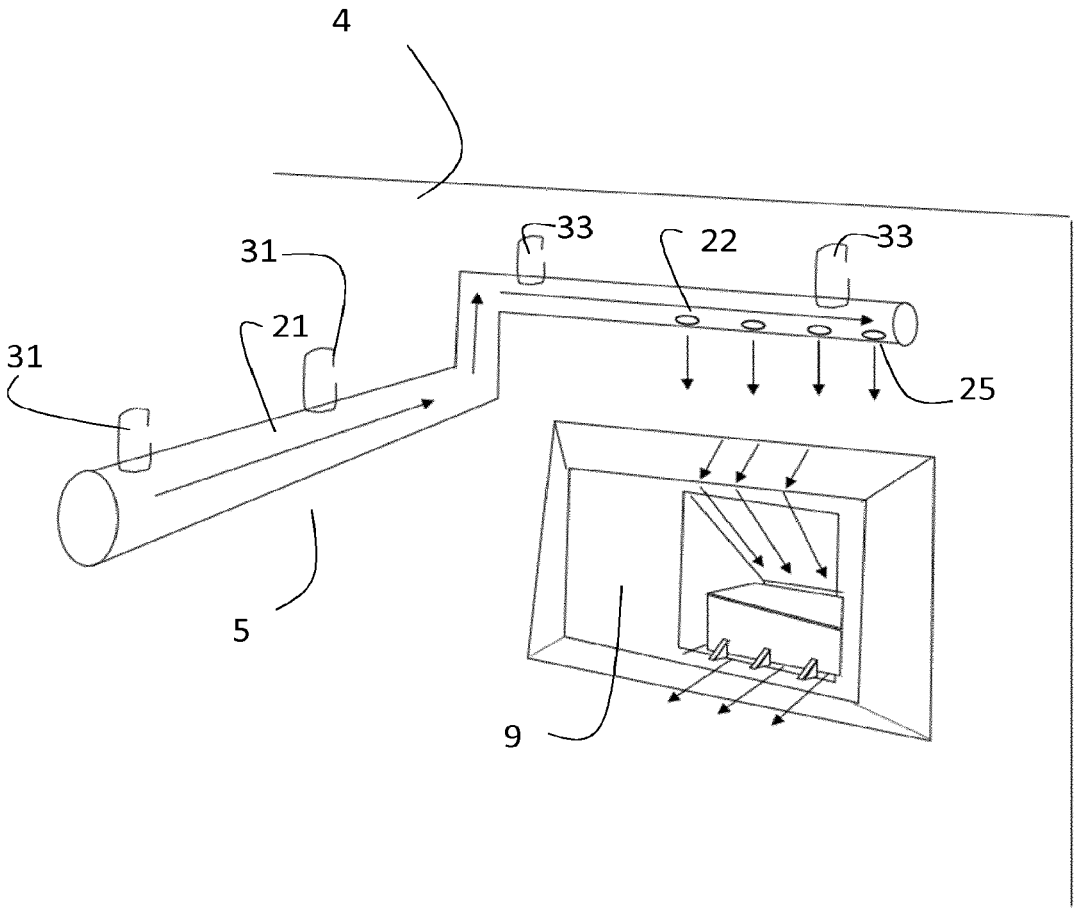
FIG. 2 is a view of an arrangement for spraying water on the door of a dishwasher.

In FIG. 2 a partial view from inside the tub 2 is depicted viewing the door 4 with the detergent dispenser 9. The detergent dispenser 9 can be supplied with water via a water conduit 21. The water flow is indicated by arrow in FIG. 2. The water conduit 21 can be connected to a water conduit system of the dishwasher via a coupling at the upper spray arm 5. In accordance with one embodiment, the water conduit 21 can be attached to the upper rack 7 with clips 31, or other means. At the door 4 a water outlet 22 is arranged to supply water to the topside of the detergent dispenser 9. The topside of the detergent dispenser typically being the upper side of the detergent dispenser when the door 4 is closed and the dishwasher is in use. Hereby water can be supplied to the topside of the detergent dispenser 9 and water can flow through the detergent dispenser 9. The water outlet 22 can also be attached to the upper rack via clips 33, or other means. In an alternative embodiment, the water outlet 22 is mounted on the door 4 and connects via a coupling to the water conduit 21. The water outlet 22 can have multiple nozzles 25 arranged thereon to output water to the detergent dispenser 9. This will typically increase the amount of water that flows through the detergent dispenser and also the water flow in the detergent dispenser can be better controlled and thereby the risk for residues being left in the detergent dispenser or that the detergent tablet is not fully dissolved is reduced.

Figure 3:
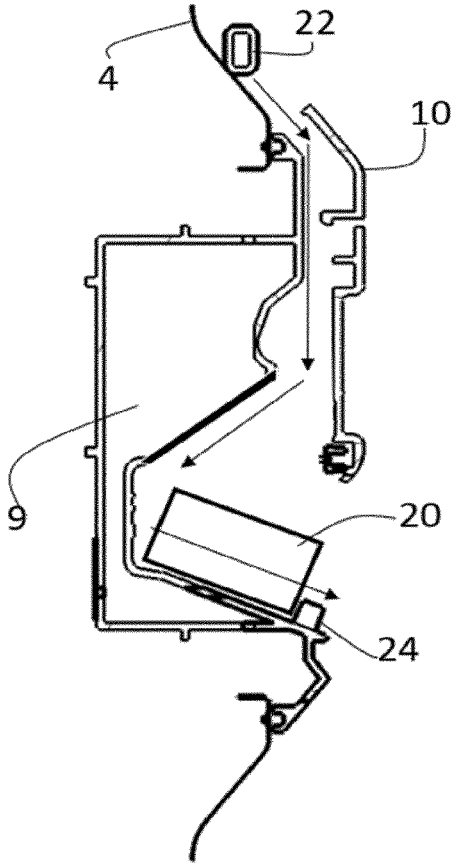
FIG. 3 is a cross-sectional view of a door of a dishwasher.

In FIG. 3 a partial cross-sectional view from the side of the door 4 is shown. FIG. 3 shows the detergent dispenser 9 and the lid 10. FIG. 3 also shows the water outlet 22 located at a top section of the detergent dispenser. The water outlet, which is fed with water via the water conduit 21, is arranged to output water to the detergent dispenser 9. The water can be released vi several laterally displaced nozzles such the water will pass all across the width of the detergent dispenser. The water passing through the dispenser is generally indicated by the arrows in FIG. 3. The water will dissolve a detergent tablet 20 placed in the detergent dispenser. The tablet 20 can rest against a tablet restraint 24 inside the detergent dispenser as will be described in more detail below. In other words, water can flow directly from a water feed of the dishwasher to the surface of the door 4. The water is sprayed onto the door or released right above the detergent dispenser. The water flows down and enter the detergent cavity washing over the detergent tablet. In accordance with one exemplary embodiment the dishwasher can be controlled to start spraying water via the water outlet when the lid is opened. By spraying water for a predetermined time and/or with a pre-determined amount via the water outlet 22 it can be assured that the detergent tablet is completely dissolved.

Figure 4:
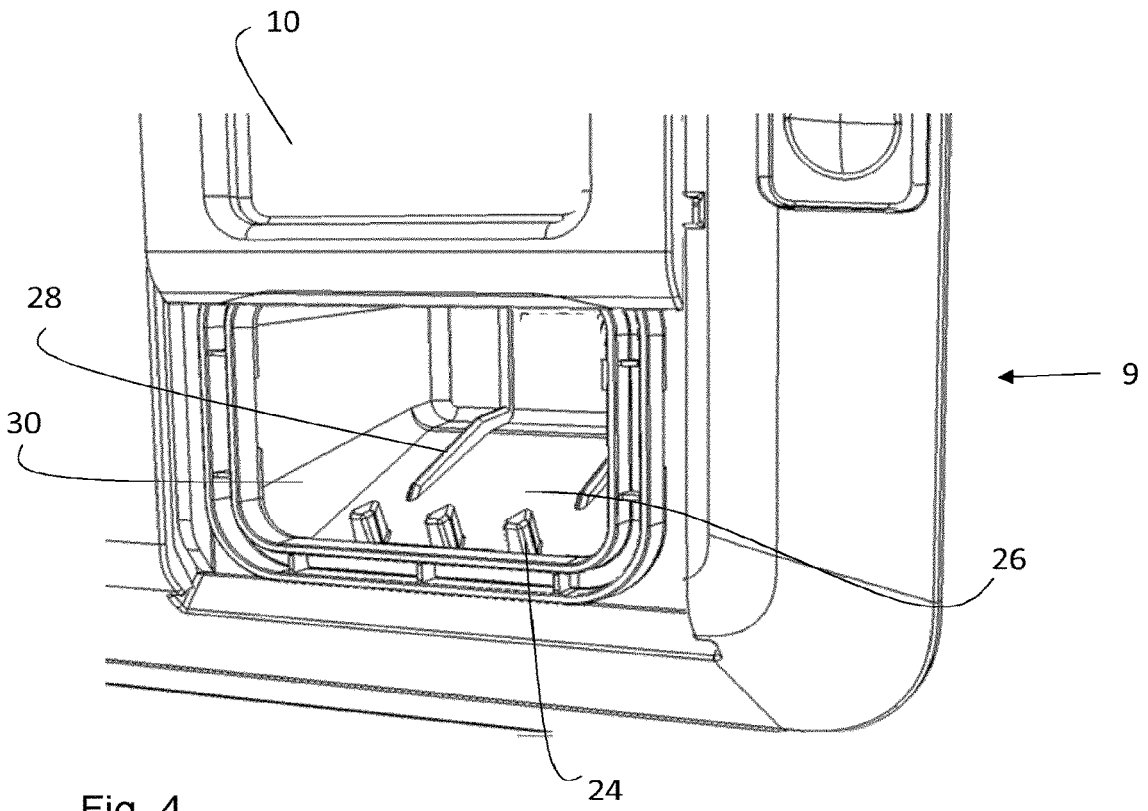
FIG. 4 is a view of a detergent dispenser.

In FIG. 4, a view of an exemplary detergent dispenser 9 is shown. In the embodiment of FIG. 4 the detergent dispenser 9 is shown with the lid open. Under the lid, a cavity 30 is formed to receive a detergent tablet. The cavity 30 has a number of tablet restraints 24 located therein. The tablet restraints 24 are configured to keep the detergent tablet in the cavity 30 while the detergent tablet is dissolved when water is flushed in the detergent dispenser from the water outlet 22 shown in FIG. 3. The tablet restraints 24 can be located on a bottom surface 26 of the cavity 30. The bottom surface 26 can be sloped such that water will exit the cavity when water is in the cavity. Also, rails 28 can be formed on the bottom surface. The rails 28 can act to facilitate detergent from leaving the cavity and also to prevent the detergent tablet to stick to the bottom surface. Also, a top section of the detergent dispenser can in some embodiments be provided with openings (not shown) for receiving water from the water outlet.

Figure 5:
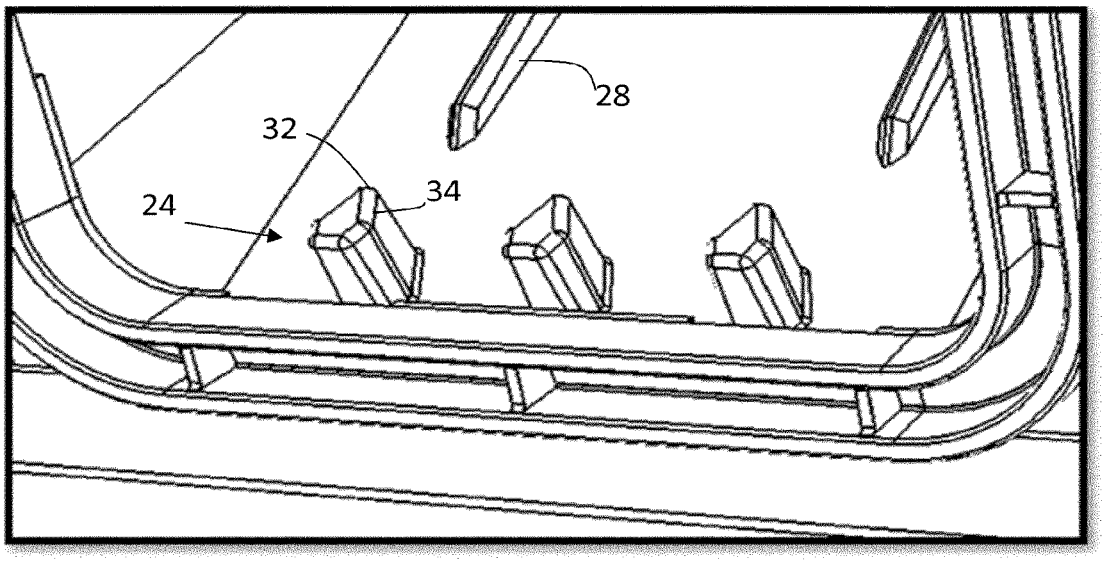
FIG. 5 is a view of a cavity of a detergent dispenser.

In FIG. 5 the tablet restraints 24 are shown in more detail. In the embodiment of FIG. 5 a multitude of tablet restraints, at least three, are provided. The tablet restraints 24 can in accordance with some embodiments be formed as teeth. The teeth can have a height of about 1 cm or less. Hereby it become easier to place the tablet inside the cavity. Also, the teeth can be provided with an upwards facing portion 32 forming an acute angle. The upwards facing portion is adapted to form a support against which a detergent tablet can rest when placed in the detergent dispenser. By providing such a structure where the tablet can rest on a sharp portion of the tablet restraints tablet residues are less likely to be left inside the cavity when the tablet is dissolved. In accordance with some embodiments the top portion of the teeth can be provided with a beveled edge 34. Hereby the risk for residues being formed in the cavity can be even further reduced.

The invention claimed is:

1. A dishwasher, comprising:

a washing compartment comprising a door attached thereto;

a detergent dispenser mounted on the door;

a water conduit fixed to a rack within the washing compartment and in fluid communication with a water outlet, and wherein the water conduit extends in a first direction, and the water outlet extends at a fixed angle relative to the first direction to be positioned above the detergent dispenser when the dishwasher is operating.

2. The dishwasher of claim 1, wherein the detergent dispenser comprises a cavity and a set of tablet restraints configured to retain a detergent tablet in the cavity.

3. The dishwasher of claim 2, wherein the tablet restraints are located at a bottom surface of the cavity in the detergent dispenser.

4. The dishwasher of claim 3, wherein the bottom surface has a sloped surface.

5. The dishwasher of claim 1, wherein an upper section of the detergent dispenser comprises an opening configured to allow water from the water outlet to enter the detergent dispenser.

6. The dishwasher of claim 1, wherein the water outlet is spaced apart from the detergent dispenser.

7. A dishwasher, comprising:

a washing compartment comprising a door attached thereto;

a detergent dispenser mounted on the door, the detergent dispenser comprising a cavity configured to receive a detergent tablet;

a water conduit fixed to a rack within the washing compartment and in fluid communication with a water outlet; and wherein the water outlet is fixedly positioned above the detergent dispenser and the water outlet comprises a nozzle directed downward to release water downward towards the detergent dispenser when the dishwasher is operating.

8. The dishwasher of claim 7, wherein the cavity comprises a rear wall, an open side opposite the rear wall and facing towards the washing compartment when the door is in a closed position, and a bottom surface extending from the rear wall to the open side.

9. The dishwasher of claim 8, wherein the detergent dispenser further comprises a protrusion attached to the bottom surface of the cavity.

10. The dishwasher of claim 9, wherein the protrusion comprises a plurality of teeth extending from the bottom surface of the cavity.

11. The dishwasher of claim 8, wherein the bottom surface is sloped downwardly towards the washing compartment.

12. The dishwasher of claim 7, wherein the detergent dispenser further comprises at least one opening at an upper section of the cavity configured to receive the water from the nozzle when the door is in a closed position.

13. A dishwasher, comprising:

a washing compartment comprising a door attached thereto;

a detergent dispenser mounted on the door, the detergent dispenser comprising a cavity having a bottom surface, a protrusion attached to the bottom surface and configured to retain a detergent tablet in the cavity, and an opening at an upper section of the cavity;

a water conduit fixed to a rack within the washing compartment and in fluid communication with a water outlet, and wherein the water outlet is fixed above the detergent dispenser and is directed downward to release water downward towards the detergent dispenser when the dishwasher is operating, and the opening is configured to receive the water from the water outlet when the door is in a closed position.

14. The dishwasher of claim 13, wherein the cavity comprises a rear wall and an open side opposite the rear wall and facing towards the washing compartment when the door is in the closed position, wherein the bottom surface extends from the rear wall to the open side.

15. The dishwasher of claim 14, wherein the protrusion is spaced from the rear wall and configured to hold the detergent tablet in the cavity on the bottom surface between the rear wall and the protrusion when the door is in the closed position.

16. The dishwasher of claim 14, wherein the detergent dispenser further comprises a lid configured to selectively close the open side of the cavity.

17. The dishwasher of claim 16, wherein the lid is configured to be moved to an open lid position in which the lid forms the opening configured to receive the supply of water.

18. The dishwasher of claim 13, wherein the bottom surface of the cavity is sloped downwardly towards the washing compartment, and the protrusion is located at a lower end of the bottom surface.

* * * * *